United States Patent [19]

Ooms

[11] Patent Number: 4,823,048

[45] Date of Patent: Apr. 18, 1989

[54] ELECTRIC LAMP HAVING PINCH A SEAL WITH PRIMARY FOILS ARRANGED BETWEEN EACH CURRENT SUPPLY CONDUCTOR AND A RESPECTIVE AUXILIARY FOIL

[75] Inventor: Leo F. Ooms, Turnhout, Belgium

[73] Assignee: U.S. Philips Corporation, New York, N.Y.

[21] Appl. No.: 168,193

[22] Filed: Mar. 15, 1988

[30] Foreign Application Priority Data

Mar. 25, 1987 [NL] Netherlands ..... 8700693

[51] Int. Cl.[4] ..... H01J 5/36; H01J 61/36; H01K 1/38

[52] U.S. Cl. ..... 313/623; 313/578; 313/332

[58] Field of Search ..... 313/332, 578, 579, 623

[56] References Cited

U.S. PATENT DOCUMENTS 3,991,337 11/1976 Notelteirs ..... 313/332 X
4,110,657 8/1978 Sobieski ..... 313/332

FOREIGN PATENT DOCUMENTS 5355279 10/1976 Japan .

*Primary Examiner*—David K. Moore
*Assistant Examiner*—K. Wieder
*Attorney, Agent, or Firm*—Brian J. Wieghaus

[57] ABSTRACT

The electric lamp has a lamp vessel provided with a pinched seal, in which a metal foil is accommodated, which is connected to an external current conductor and to an internal current conductor. The metal foil has a welding connection with the internal current conductor on its first major surface. A metal auxiliary foil is welded against the second major surface of the metal foil and is welded against the internal current conductor. The lamp has a simple construction and has during operation a comparatively low temperature of the pinched seal.

8 Claims, 1 Drawing Sheet

ELECTRIC LAMP HAVING PINCH A SEAL WITH PRIMARY FOILS ARRANGED BETWEEN EACH CURRENT SUPPLY CONDUCTOR AND A RESPECTIVE AUXILIARY FOIL

BACKGROUND OF THE INVENTION

The invention relates to an electric lamp having a light source arranged within, A lamp vessel which is sealed in a vacuum-tight manner and made of glass having an $SiO_2$ content of at least 95% by weight and having a pinched seal at an end thereof.

A metal foil having a first and a second end is included as a current lead-through conductor in the said pinched seal.

The metal foil being connected near its first end to at least one external current conductor, which is passed to the exterior from the said pinched seal.

The metal foil having a first and a second major surface and having near its second end on a first major surface a welding connection with an internal current conductor extending to the light source.

A metal auxiliary foil is near the second end of the said metal foil, which forms an additional connection between the metal foil and said internal current conduction.

Such an electric lamp is known as an incandescent lamp from JP UM Application No. 51-137898.

In the known lamp, the internal current conductor is enclosed, as far as it overlaps the metal foil, between said metal foil and the metal auxiliary foil. This construction has a number of great disadvantages. The end of the internal current conductor welded to the metal foil should be bevelled in order that the metal auxiliary foil can follow exactly the surface of the internal current conductor. Without this measure, there is a risk that, when the pinched seal is formed, the metal auxiliary foil is subjected to tensile stress and breaks. Another disadvantage is that cavities are formed between the two foils on either side of the internal current conductor. Consequently, the foils are subjected to a considerable extent to the atmosphere prevailing in the lamp. A further disadvantage is that the assembly of the current conductor to the light source can be manufactured only with great difficulty.

Certain electric lamps are very heavily loaded during operation. A high current of, for example, several tens of amperes flows through these lamps, which leads to high current densities in the pinched seal especially at the transition from the metal foil to the internal current conductor. This results in a strong development of heat in the pinched seal. The maximum permissible temperature of the pinched seal can thus be readily exceeded.

Exceeding of this temperature causes the metal foil and the external current conductor to oxidize so rapidly that the pinched seal bursts and the lamp becomes leaky before the calculated life of the lamp is attained. Therefore, it is of major importance that a lamp is available having a construction which keeps the temperature of the pinched seal sufficiently low during operation, so that the oxidation in the pinched seal does not determine the lifetime of the lamp.

A contribution to a temperature reduction is obtained by a suitable construction of the transition from the metal foil to the external current conductor. It is known, for example, to weld several external current conductors to the first end of the metal foil and to interconnect these current conductors outside the lamp. The temperature reduction thus obtained is insufficient, however, with heavily loaded lamps. A similar construction of the transition from the metal foil to the internal current conductors generally cannot be realized in practice.

SUMMARY OF THE INVENTION

The invention has for its object to provide a lamp of the kind described in the opening paragraph having a construction which can be readily manufactured and prevents the temperature of the pinched seal from rising excessively during operation.

According to the invention, this object is achieved in a lamp of the kind described in the opening paragraph in that the metal auxiliary foil is welded against the second major surface of the metal foil and against the said internal current conductor.

In view of the high currents through the lamp, the internal current conductor has a large diameter, for example of 1 mm or larger, while the metal foil, in order that a vacuum-tight seal of the lamp vessel can be attained, has a thickness of only a few tens of microns, for example 40 μum.

In spite of this large and small thickness respectively, the current conduction means of the lamp according to the invention can be readily assembled. As show in the drawing, the metal foil is located between the metal auxiliary foil and the internal current conductor. The welding connections between these components can be readily formed, for example in a welding jig. Deformation of the metal foils substantially does not occur. Furthermore, the metal foil and the metal auxiliary foil are firmly pressed against each other when the pinched seal is formed and come into a more intimate physical and electrical contact with one another. It is further important that the glass of the pinch seal is in intimate contact with the metal foil and with the metal auxiliary foil. The heat transfer to the glass of the pinch seal and thence to its environment is thus improved.

Due to this simple construction, the electric current is introduced more gradually and with a larger spread from the internal current conductor into the metal foil, and conversely. This results in a smaller development of heat.

The lamp according to the invention may have two pinched seals, each of which accommodates its own metal oil and an internal and an external current conductor secured thereto, or this lamp may be such that one pinched seal accommodates these two metal foils.

In order to further reduce the temperature, the external current conductors may each consist of several wires. Alternatively, a respective metal auxiliary foil may be used with the external current conductors.

The electric lamp may be a gas discharge lamp, in which event the light source is a pair of electrodes in an ionizable medium, or this lamp may be an incandescent lamp, for example a halogen incandescent lamp, in which the light source is a filament.

It is common practice that metal foils have between their first and second ends side edges which are etched (feathered edges), in order to ensure that the glass of the pinched seal satisfactorily adjoins the metal foil and hence vacuum-tightness is obtained. It has proved to be favorable, in order to avoid stresses in the pinch seal, that the metal auxiliary foil is also provided with etched side edges.

BRIEF DESCRIPTION OF THE DRAWINGS

An embodiment of the lamp according to the invention is shown in the drawing.

In the drawing.

DESCRIPTION OF THE PREFERRED EMBODIMENT

Figure 1:
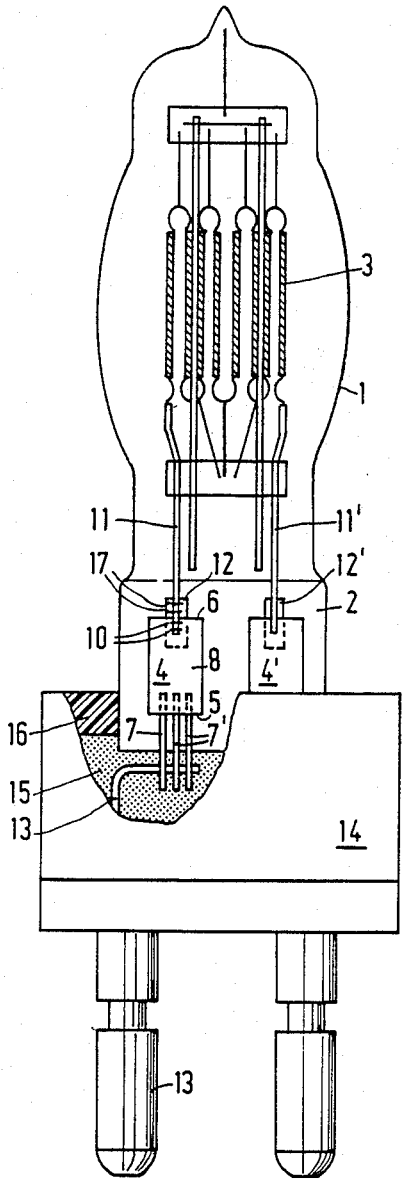
FIG. 1 is a front elevation of an incandescent lamp with a lamp cap partly broken away.

In FIG. 1, the electric incandescent lamp has a lamp vessel 1 sealed in a vacuum-tight manner and made of glass having an $SiO_2$ content of at least 95% by weight, for example quartz glass, which has at one end a pinch seal 2. A filament 3 is arranged as a light source within the lamp vessel 1. At least one metal foil 4 of, for example, molybdenum is accommodated in the pinch seal 2 and has a first and a second end 5 and 6, respectively, serving as a current lead-through conductor.

Figure 2:
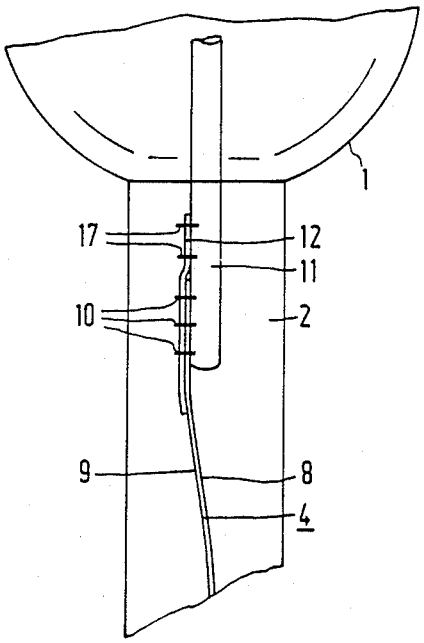
FIG. 2 shows a detail of the lamp shown in FIG. 1 in side elevation on a strongly enlarged scale.

The metal foil 4 is connected near a fist end 5 by welding to an external current conductor 7, which is passed to the exterior from the pinch seal 2. In the embodiment shown, there are several external current conductors 7, 7'. The metal foil 4 has a first major surface 8 and a second major surface 9 (FIG. 2). Near its second end 6, the metal foil has on the first major surface 8 a welding connection 10 with an internal current conductor 11 extending to the light source 3.

A metal auxiliary foil 12 of, for example, molybenum near the second end 6 of the metal foil 4 forms an additional connection between the metal foil 4 and the internal current conductor 11. The metal auxiliary foil 12 is welded against the second major service 9 (FIG. 2) of the metal foil (welds 10) and is welded against the internal current conductor 11 (weld 17).

In the drawing, the pinch seal 2 has a second metal foil 4', which is connected to a second internal current conductor 11' with the use of a metal auxiliary foil 12'.

The external current conductors 7,7' are all connected to a contact 13 of a lamp cap 14. The lamp cap 14 is filled partly with sand 15 and partly with cement 16, which ensures that the lamp vessel 1 is fixed in the lamp cap 14.

In a lamp according to the invention, the internal current conductors 11 of tungsten had a diameter of 1.5 mm, while the metal foil 4 and the metal auxiliary foil 12 had a thickness of 45 μum.

The lamp used as film studio lamp consumed during operation at 120 V a power of 5 kW so that the current through the lamp was about 42 A. The lamp reached the calculated lifetime without the pinched seal being damaged.

In FIG. 2, the detail of the lamp of FIG. 1 shows that the metal foil 4 is in intimate contact with the metal auxiliary foil 12 and with the internal current conductor 11. The side edges shown of the two foils 4, 12 and the side edges extending parallel thereto are etched in order to make said foils thinner along said side edges and to cause their major surfaces (8, 9 with the foil 4) to enclose at these side edges an acute angle with each other.

Due to the construction shown, the current is introduced more satisfactorily from the internal current conductor 11 gradually into the foil 4, and conversely. The current conduction means 11, 4, 12 is thicker at the area of the welds 10 than without a metal auxiliary foil 12. Nevertheless, the glass of the pinched seal 2 adjoins very satisfactorily especially the foils 4, 12.

Due to the construction of the lamp, development of heat in the pinched seal 2 is counteracted and developed heat is transferred excellently to the glass of the pinched seal 2 and is thence dissipated to the ambient atmosphere. The lamp can be readily manufactured.

What is claimed is:

1. An electric lamp, comprising:

(a) a lamp envelope having a pinch seal;

(b) a light source energizable for emitting light arranged within said lamp envelope; and (c) a current-supply conductor comprising an internal conductor connected to said light source having an end portion entering said pinch seal, an external conductor extending into said pinch seal from the exterior having an end portion within said pinch seal spaced from said end portion of said internal conductor, a primary metal foil extending in the pinch seal between said external and internal conductors, said primary metal foil having a first end portion welded to said end portion of said internal conductor and a second end portion welded to said end portion of said external conductor, and an auxiliary metal foil having a first portion welded to said internal conductor adjacent said first end portion of said primary foil and having a second portion which extends over and is welded to said first end portion of said primary foil such that said first end portion of said primary foil is disposed between said second portion of said auxiliary metal foil and said end portion of said internal conductor.

2. An electric lamp as claimed in claim 1, wherein the primary metal foil is connected at its second end portion to several external conductors.

3. A lamp as claimed in claim 1, wherein said auxiliary foil extends contiguous said primary foil for a predetermined distance past said first end portion of said internal conductor in the direction of said external conductor.

4. A lamp as claimed in claim 3, wherein said auxiliary foil and said primary foil have feathered edges.

5. A lamp as claimed in claim 1, wherein said auxiliary foil and said primary foil have feathered edges.

6. A lamp as claimed in claim 1, wherein said lamp comprises two of said current-supply conductors extending through said pinch seal in side-by-side arrangement.

7. An electric lamp as claimed in claim 6, wherein for each current-supply conductor said primary metal foil is connected at its second end portion to several external conductors.

8. A lamp as claimed in claim 7, wherein for each current-supply conductor said auxiliary foil and said primary foil have feathered edges.

* * * * *